US007819656B2

(12) United States Patent
Ponzi et al.

(10) Patent No.: US 7,819,656 B2
(45) Date of Patent: Oct. 26, 2010

(54) HEATER AND METHOD OF OPERATION

(75) Inventors: Peter R Ponzi, Randolph, NJ (US); Francesco Bertola, Nutley, NJ (US); Robert J Gartside, Summit, NJ (US)

(73) Assignee: Lummus Technology Inc., Bloomfield, NJ (US)

( * ) Notice: Subject to any disclaimer, the term of this patent is extended or adjusted under 35 U.S.C. 154(b) by 0 days.

(21) Appl. No.: 11/804,362

(22) Filed: May 18, 2007

(65) Prior Publication Data

US 2008/0286706 A1 Nov. 20, 2008

(51) Int. Cl.
*F23D 14/12* (2006.01)
*B01J 10/10* (2006.01)

(52) U.S. Cl. ..... 431/8; 431/9; 431/10; 431/170; 110/345; 110/347; 110/261; 110/348

(58) Field of Classification Search ..... 110/347, 110/345, 261, 348, 343; 431/8–10, 170
See application file for complete search history.

(56) References Cited

U.S. PATENT DOCUMENTS

| | | | | |
|---|---|---|---|---|
| 3,240,204 | A | 3/1966 | Wiesenthal | 126/109 |
| 4,342,642 | A | 8/1982 | Bauer et al. | 208/130 |
| 4,434,727 | A | 3/1984 | McCartney | 110/347 |
| 5,409,675 | A | 4/1995 | Narayanan | 422/197 |
| 5,823,769 | A | 10/1998 | Joshi et al. | 432/181 |
| 6,193,940 | B1 | 2/2001 | Kang et al. | |
| 6,425,757 | B1 | 7/2002 | Chapman et al. | 432/146 |
| 6,685,893 | B2 | 2/2004 | Platvoet et al. | 422/198 |
| 6,699,030 | B2 * | 3/2004 | Bool et al. | 431/10 |
| 6,729,874 | B2 | 5/2004 | Poe et al. | 431/354 |
| 6,796,790 | B2 | 9/2004 | Venizelos et al. | 431/8 |
| 6,846,175 | B2 | 1/2005 | Spicer | 431/9 |
| 6,866,502 | B2 | 3/2005 | Stephens | 431/9 |
| 6,869,277 | B2 | 3/2005 | Stephens | 431/9 |
| 6,877,980 | B2 | 4/2005 | Stephens et al. | 431/115 |
| 6,884,062 | B2 | 4/2005 | Stephens et al. | 431/5 |
| 6,887,068 | B2 | 5/2005 | Spicer | 431/9 |

(Continued)

FOREIGN PATENT DOCUMENTS

DE 4034008 A1 5/1991

(Continued)

OTHER PUBLICATIONS

PCT/IB/326; International Preliminary Report on Patentability; Written Opinion of the International Searching Authority dated Nov. 24, 2009.

(Continued)

*Primary Examiner*—Steven B McAllister
*Assistant Examiner*—Nikhil Mashruwala
(74) *Attorney, Agent, or Firm*—Osha • Liang LLP

(57) ABSTRACT

A furnace, firing pattern and method of operating a heater that employs a combination of hearth burners and wall burners for the cracking of hydrocarbons is described. The firing pattern leads to improvements in the uniformity of the coil metal temperatures and vertical heat flux profiles over the firebox elevation. The hearth burners operate with a stoichiometric excess of air while the wall burners operate with less than the stoichiometric amount of air.

34 Claims, 9 Drawing Sheets

U.S. PATENT DOCUMENTS

| | | | | |
|---|---|---|---|---|
| 6,890,171 | B2 | 5/2005 | Stephens et al. | 431/8 |
| 6,890,172 | B2 | 5/2005 | Stephens et al. | 431/9 |
| 6,893,251 | B2 | 5/2005 | Stephens | 431/9 |
| 6,893,252 | B2 | 5/2005 | Stephens et al. | 431/9 |
| 6,902,390 | B2 | 6/2005 | Spicer | 431/5 |
| 6,905,328 | B2 | 6/2005 | Poe | 431/175 |
| 7,019,187 | B2 | 3/2006 | Powers | 585/648 |
| 7,025,587 | B2 | 4/2006 | Stephens et al. | 431/9 |
| 7,172,412 | B2 * | 2/2007 | Platvoet et al. | 431/9 |
| 2002/0064740 | A1 | 5/2002 | Venizelos et al. | 431/8 |
| 2005/0106518 | A1 | 5/2005 | Platvoet et al. | 431/9 |
| 2005/0158681 | A1 * | 7/2005 | Bussman et al. | 431/348 |

FOREIGN PATENT DOCUMENTS

| | | | |
|---|---|---|---|
| EP | 0562816 | A2 | 9/1993 |
| EP | 1580484 | A2 | 9/2005 |
| FR | 2761371 | A1 | 10/1998 |

OTHER PUBLICATIONS

Translation of Examiner's First Report issued in corresponding Chilean application No. 1450-2008 (4 pages).

* cited by examiner

HEATER AND METHOD OF OPERATION

BACKGROUND

The embodiments disclosed herein relate to heaters and more particularly to the efficient design and operation of such heaters.

The steam cracking or pyrolysis of hydrocarbons for the production of olefins is often carried out in tubular coils located in fired heaters. The pyrolysis process is considered to be the heart of an olefin plant and has a significant influence on the economics of the overall plant.

The hydrocarbon feedstock may be any one of the wide variety of typical cracking feedstocks such as methane, ethane, propane, butane, mixtures of these gases, naphthas, gas oils, etc. The product stream contains a variety of components; the concentrations of these components are dependent in part upon the feed selected. In a conventional pyrolysis process, vaporized feedstock is fed together with dilution steam to a tubular reactor located within the fired heater. The quantity of dilution steam required is dependent upon the feedstock selected; lighter feedstocks such as ethane require lower steam (0.2 lb./lb. feed), while heavier feedstocks such as naphtha and gas oils require steam/feed ratios of 0.5 to 1.0. The dilution steam has the dual function of lowering the partial pressure of the hydrocarbon and reducing the fouling rate of the pyrolysis coils.

Fouling on the inside surface of the radiant pyrolysis coils is one of the determining factors for the onstream time of these heaters. As the time of operation increases, the buildup of coke creates a resistance to heat transfer from the radiant firebox. In order to maintain constant process performance, as exemplified by a constant outlet temperature of the coil, the heat flux to the coil must be maintained. The coke layer on the inside of the coil acts as a resistance to heat flux and the outside metal temperature of the tube must increase to allow for the equivalent flux through a higher resistance. The time that a heater can operate before a shutdown to remove the coke deposits depends on two primary factors. The first is the rate of fouling. Fouling occurs as coke builds up on the radiant heating coil. As coke is deposited on the coil, it inhibits the transfer of heat from the coil. As a result, the buildup of coke requires more heat to be added to the system to maintain the efficiency of the heater. The rate of fouling is a function of process load (heat flux required), dilution steam, temperature at the metal surface on the inside of the coil, and the characteristics of the feedstock itself. For example, heavier feeds coke faster than lighter feeds. It is desired to maximize the onstream time.

The second factor is the makeup of the radiant heating coil. Typically, the coil is made up of a metal or metal alloy. Metals and alloys are sensitive to extreme temperatures. That is, if the radiant coil is exposed to a temperature above its maximum mechanical threshold, it will begin to deteriorate, causing damage to the radiant heating coil. As a result, a typical pyrolysis heater must be carefully monitored to maintain specific temperature ranges. This become problematic as coke builds up on the coil because more heat must be added to maintain the efficiency of the system.

As a result, it is desirable to design pyrolysis coils with long cycle times to minimize the maximum tube metal temperatures while maximizing the total heat transferred through the coil. This allows for the maximum temperature rise at a constant fouling rate.

In a typical pyrolysis process, the steam/feed mixture is preheated to a temperature just below the onset of the cracking reaction, which is usually about 600° C. This preheat occurs in the convection section of the heater. The mix then passes to the radiant section where pyrolysis reactions occur. Generally the residence time in the pyrolysis coil is in the range of 0.2 to 0.4 seconds and outlet temperatures for the reaction are on the order of about 700° to 900° C. The reactions that result in the transformation of saturated hydrocarbons to olefins are highly endothermic thus requiring high levels of heat input. This heat input must occur at elevated reaction temperatures. It is generally recognized in the industry that for most feedstocks, and especially for heavier feedstocks such as naphtha, shorter residence times will lead to higher selectivity to ethylene and propylene since secondary degradation reactions will be reduced. Further it is recognized that the lower the partial pressure of the hydrocarbon within the reaction environment, the higher the selectivity.

The flue gas temperatures in the radiant section of the fired heater are typically above 1,100° C. The heat transfer to the coils is primarily by radiation. In some conventional designs, approximately 32 to 40% of the heat fired as fuel into the heater is transferred into the coils in the radiant section. The balance of the heat is recovered in the convection section either as feed preheat or as steam generation. Given the limitation of small tube volume to achieve short residence times and the high temperatures of the process, heat transfer into the reaction tube is difficult. As a result, high heat fluxes are used and the operating tube metal temperatures are close to the mechanical limits for even exotic metallurgies. In most cases, tube metal temperatures limit the extent to which residence time can be reduced as a result of a combination of higher process temperatures required at the coil outlet and the reduced tube length (hence tube surface area) which results in higher flux and thus higher tube metal temperatures. Tube metal temperatures are also a limiting factor in determining the capacity of these radiant coils since more flux is required for a given tube when operated at higher capacity. The exotic metal reaction tubes located in the radiant section of the cracking heater represent a substantial portion of the cost of the heater so it is important that they be utilized fully. Utilization is defined as operating at as high and as uniform a heat flux as possible consistent with the design objectives of the heater. This will minimize the number and length of the tubes and the resulting total metal surface area required for a given pyrolysis capacity.

In a typical cracking furnace, the heat is supplied by a combination of hearth and wall burners. The pyrolysis coils are typically suspended from the top of the radiant section and hang between two radiant walls. The hearth and wall burner combination heats the walls of the furnace that then radiate to the coils. A small portion of the heat transferred is done convectively by the flue gases within the firebox transferring the heat directly to the coils. However in a typical furnace, greater than 85% of the heat is transferred radiatively. Hearth burners are installed in the floor of the firebox and fire vertically up along the walls. Wall burners are located in the vertical walls of the furnace and fire radially out along the walls.

In any flame from a burner, there is a characteristic combustion profile. As the fuel and air mixture leaves the burner, combustion begins. As the combustion reaction continues, the temperature of the combustion mixture increases and heat is released. At some distance from the burner, there is a point of maximum combustion and hence maximum heat release. During this process, heat is absorbed by the process coil. The characteristics of the flame depend upon the total firing from that burner and the specifics of the burner design. Different flame shapes and heat release profiles are possible, depending upon how the fuel and air are mixed. Hearth burners typically operate at a fired duty between about 5 and 15 MM BTU/hr. In these burners, the point of maximum combustion is typically about 3 to 4 meters above the burner itself. Because of the characteristic heat release profile from these burners, an uneven heat flux profile (heat absorbed profile) is sometimes created. The typical flux profile for the radiant coil shows a peak flux near the center elevation of the firebox (at the point of maximum combustion or heat release for the hearth burners) with the top and bottom portions of the coil receiving less flux. In some heaters, radiant wall burners are installed in the top part of the sidewalls to equalize the heat flux profile in the top portion of the coil. Typical coil surface heat flux profiles and metal temperature profiles for a hearth burner and for a combination of hearth and wall burners at the same heat liberation rate show low heat flux and metal temperature in the lower portion of the firebox, which means that the coil in this portion may be underutilized.

There have been a number of attempts to control the flux profile within a pyrolysis heater. It is known that staging the fuel to hearth burners can be used to adjust the flame shape and thus impact the point of maximum heat release. Hearth burners are typically designed with several differing fuel injection points. Air is drawn into the furnace via either by natural or induced draft or by inspiration with fuel utilizing a venturi system. A primary fuel is injected into this air stream with the purpose of providing sufficient combustion to develop a stable flame. In some cases another small fuel injection point is used just adjacent to this primary flame to help stabilize the flame and prevent flame blowout. Older hearth burners typically feed 100% of the hearth burner fuel fired with these primary fuel injection points. The combustion occurred at an air to fuel ratio of slightly above stoichiometric (10-15% excess air).

When $NO_x$ values are an important consideration, some of the fuel from the primary injection point can be removed from the entering air flow and placed in secondary or staged tips just at the edge of the burner. This fuel is directed such that it will mix with the flowing air and primary fuel stream at some distance above the burner. By "staging" the mixing of fuel and air, the combustion profile of the flame can be altered, leading to a lower flame temperature and hence lower $NO_x$. This technique also changes the point of maximum combustion and thus impacts the resultant flux profile to the coil. Staging the fuel does not change the net air to fuel ratio of the burner, it just changes when and where the fuel is mixed. The amount of secondary fuel injection, the location of that injection point at the edge of the burner, and the angle at which it is injected all impact the $NO_x$ values, flame shape, and hence the coil metal temperature profile.

U.S. Pat. No. 4,887,961 describes radiant wall burners in which air and fuel are pre-mixed in a venturi to proportions equivalent to 10-15% excess air. The venturi is sized to inspirate the correct amount of air using the fuel as the motive force in the throat of the venturi. In U.S. Pat. No. 6,796,790 a wall burner is described that takes part of the fuel and injects it just beyond the "can" or "deflector" and relies on fluid dynamics to pull this "secondary staged fuel—for wall burners" into the flow of 100% of the air and part of the fuel.

U.S. Pat. No. 6,616,442 describes a hearth burner with a first "zone" just above the burner where the mixture of fuel and air (excess air) leaves the tile and burns. The second "zone" is at a higher elevation where the secondary fuel mixes with the burning air/fuel mixture. The net resulting air to fuel mix at the second zone is slightly above a stoichiometric ratio.

Another means of controlling coil metal temperatures is described in U.S. Pat. No. 6,685,893. In this patent, a wall burner is specifically placed in the floor of the furnace and the flame is directed along the floor in order to heat the refractory floor of the furnace and provide additional radiation surface for the lower portion of the coil. The base burner can be designed to inspirate air and produce a slightly greater than stoichiometnc air to fuel mixture for combustion. Alternately the base burner can utilize fuel withdrawn from the secondary staged tips of the hearth burner. In order to have a stable flame from the base burner, some quantity of air is required to be fed with this fuel. Since the base burner is located in very close proximity to the hearth burner, there are a number of combinations of air and fuel for these separate burners that still result in a slightly greater than stoichiometric combustion mixture at or near the floor of the heater. The vertically firing hearth burner can operate with excess air and the base burner with a sub-stoichiometric amount of air or they can be operated in reverse with the base burner having excess air and the hearth burner with slightly sub-stoichiometric air. Some important design points are that by making the floor part of the radiant surface, the tube metal temperature can be reduced, and by staging the combustion through by staging of the fuel (and excess air location at the floor), $NO_x$ production can be reduced.

In U.S. Pat. No. 7,172,412, a different approach is used to control metal temperatures and flux profiles. Fuel is withdrawn from the secondary staged tips of the hearth burner and injected into the furnace at some distance above the hearth burner through the walls of the furnace. This injection serves to create a low pressure zone along the wall and thus the flame is "pulled" to the wall thus reducing proximity of the point of maximum combustion to the pyrolysis coil. Under these conditions, the hearth burner is operated under excess air conditions while the balance of the fuel is added through the wall at a point above the hearth burner. This approach not only stages the fuel to reduce $NO_x$ but alters the flame shape by pulling it back to the wall thus reducing metal temperatures.

Improving the hearth burner flux profile can be difficult because of $NO_x$ requirements and because of the steadily increasing demand for higher burner heat releases. Another way to equalize the flux profile is by using wall burners only. However, since the maximum heat release of a wall burner is about 10 times less than that of a hearth burner, the significant number of wall burners needed to generate an equivalent heat release profile limits the practicality of this approach.

SUMMARY

One disclosed feature of the embodiments is a method of operating a heater that includes a radiant heating zone having a bottom hearth portion and opposing walls adjacent to and extending upwardly from the bottom hearth portion. The heater also includes at least one tubular heating coil located in the radiant heating zone, a hearth burner section comprising a plurality of hearth burners located adjacent to the bottom hearth portion for firing in the radiant heating zone, and a wall burner section comprising a plurality of wall burners located adjacent to the opposing walls. The method comprises introducing to the wall burner section a first air and fuel mixture having less than the stoichiometric quantity of air for combustion of fuel introduced to the wall burner section, and introducing to the hearth burner section a second air and fuel mixture having greater than the stoichiometric quantity of air for combustion of fuel introduced to the hearth burner section. The overall quantity of air introduced to the hearth burners and wall burners is at least a stoichiometric quantity.

In certain cases, the mixture of air and fuel introduced to each of the wall burners has a sub-stoichiometric quality of air for combustion of fuel introduced to that wall burner. Sometimes, the mixture of air and fuel introduced to each of the hearth burners has greater than the stoichiometric quantity of air for combustion of fuel introduced to that hearth burner. In some cases, the mixture of air and fuel introduced to each of the wall burners has a sub-stoichiometric quality of air for combustion of fuel introduced to that particular wall burner.

Another disclosed feature of the embodiments is a method of operating a heater comprising a bottom hearth portion and opposing walls adjacent to and extending upwardly from the bottom hearth portion forming a radiant heating zone, at least one tubular heating coil located in the radiant heating zone, a hearth burner section comprising a plurality of hearth burners located adjacent to the bottom hearth for firing in the radiant heating zone, and a wall burner section comprising a plurality of wall burners located adjacent to the opposing walls. The method comprises introducing a first air and fuel mixture to a wall burner section, the first air and fuel mixture having less than the stoichiometric quantity of air for combustion, introducing a second air and fuel mixture to the hearth burner section in the heater in a direction generally parallel to the length of the heating coil, the second air and fuel mixture having more than the stoichiometric quantity of air for combustion; and combusting the fuel and air in the radiant heating zone. Air and a portion of the fuel introduced at the wall burner section combust at a first combustion rate, and a portion of the air introduced at the hearth burner section combusts with a portion of the fuel introduced at the wall burner section at a second combustion rate that is slower than the first combustion rate. This reduces the overall combustion rate in the wall burner section of the heater as compared to a system in which stoichiometric quantities of air are introduced in the wall burner section. In some cases, the temperature difference along the length of the heating coil is at least 10 K smaller than the temperature difference along a heating coil for a heater using equivalent overall flow rates of fuel and air in which a stoichiometric quantity of air is introduced at the wall burner section.

In certain embodiments, the first air and fuel mixture has no more than about 85% of the stoichiometric quantity of air for combustion. Sometimes, the first air and fuel mixture has between about 50% to 80% of the stoichiometric quantity of air for combustion.

According to aspects illustrated herein, there also is provided a heater comprising a radiant heating zone having a bottom hearth portion and opposing walls extending upwardly from the bottom hearth portion, at least one tubular heating coil located in the radiant heating zone, a hearth burner section comprising a plurality of hearth burners located adjacent to the bottom hearth portion and being configured to fire with greater than stoichiometric amounts of air; and a wall burner section comprising a plurality of wall burners located adjacent to the opposing walls and being configured to fire along the opposing walls in the radiant heating zone with less than stoichiometric amounts of air.

Another embodiment is a firing pattern for a gas heater having a hearth burner section and a wall burner section. The firing pattern comprises operating the wall burner section with less than the stoichiometric quantity of air for combustion and feeding additional air to the hearth burner section to result in an overall net excess of air being fed to the heater. In some cases, when the gas heater is a pyrolysis heater with a heating coil, the firing pattern reduces the difference between the maximum and minimum outer surface temperature along the length of the heating coil by at least 10 K as compared to a firing pattern in which the same fuel distribution pattern is used but the wall burner section is operated using at least a stoichiometric quantity of air. In some cases, when the gas heater is a pyrolysis heater with a heating coil, the firing pattern reduces the maximum heat flux along the length of the heating coil by at least 4% as compared to a firing pattern in which the same fuel distribution pattern is used but the wall burner section is operated using at least a stoichiometric quantity of air.

DETAILED DESCRIPTION

Figure 1:
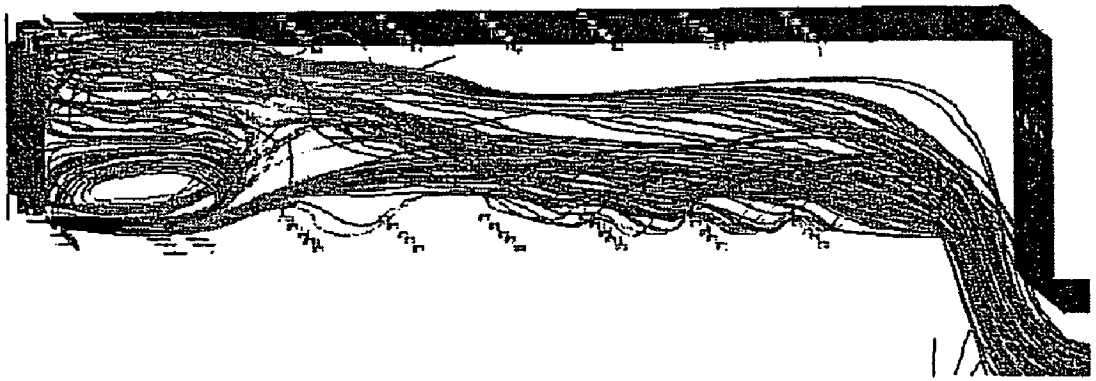
FIG. 1 is a diagram of a typical flow pattern within a firebox of a heater having hearth burners.

The embodiments disclosed herein include a firing pattern useful for a fuel firing system in a pyrolysis furnace such as an ethylene furnace. The firing pattern includes a plurality of wall burners operating under fuel rich conditions. The balance of the air required to combust the wall burner fuel is supplied by a plurality of hearth burners, which operate under conditions of greater than stoichiometric air. The net result of modifying the air distribution within the firebox is a substantial reduction in the tube metal temperature as compared to a furnace operating under equivalent fuel firing conditions but using a stoichiometric or near stoichiometric air/fuel distribution pattern in the hearth burners and the wall burners. The disclosed firing pattern provides for increased operating run lengths before requiring the decoking of the process tubes, and/or permits a heater to operate under conditions of increased severity (higher temperatures in the firebox) while maintaining run lengths that are equivalent to or longer than conventional furnace operation methods.

As used herein, a "wall burner section" is a section of the heater that includes wall burners and optionally includes other supplemental introduction points for air and/or fuel that are associated with the wall burners. In this disclosure, air and/or fuel introduced "to a wall burner" or "to the wall burners" includes air and/or fuel introduced directly through wall burners and also air and/or fuel added to the wall burner section through other introduction points associated with the wall burners. Air and/or fuel introduction points "associated with" the wall burners are typically located about ⅓ to 5 meters away from a wall burner.

As used herein, a "hearth burner section" is a section of the heater than includes hearth burners and optionally includes other supplemental introduction points for air and/or fuel that are associated with the hearth burners. In this disclosure, air and/or fuel introduced "to a hearth burner" or "to the hearth burners" includes air and/or fuel introduced directly through the hearth burners and also air and/or fuel added to the hearth burner section through other introduction points associated with the hearth burners. Air and/or fuel introduction points "associated with" the hearth burners are typically located about ⅓ to 5 meters away from a hearth burner. An air and/or fuel introduction point located between a hearth burner and a wall burner is deemed to be associated with whichever burner is closer. An air and/or fuel introduction point located between two wall burners or between two hearth burners is deemed to be associated with the closer of the two burners.

As used herein, "air and fuel mixture" refers to a combination of air and fuel introduced together. The air and fuel can either be pre-mixed before introduction or can become mixed after introduction.

In an ethylene heater, the typical temperature rise of the outer surface of the heating coil is about 1-3 K per day due to the increased resistance to heat transfer caused by coking on the inside of the process coil. When the process tubes are constructed of high temperature metallurgy, a typical maximum mechanically allowable tube metal temperature is on the order of 1388 K. The furnace operating cycle length is determined by the allowable metal temperature rise. The allowable metal temperature rise is defined as the difference between a starting clean coil metal temperature and the maximum mechanically allowable metal temperature, divided by the temperature rise per day resulting from coking. A reduction in the tube metal temperature of 15° K. will result in an increase in operating time of about 5-10 days before decoking is needed if the system is operated at the same firing rate. If it is desired to keep the same cycle time before cleaning, the system can be run at a higher firing rate, thus increasing the temperature rise per day due to coking, if the initial tube metal temperature has been reduced. The higher firing rate will result in increased conversion or furnace capacity.

In a conventional furnace operating at 10-15% excess air, there is a flue gas recirculation pattern set up within the furnace. The vertical flow of the firing from the hearth burners rises along the wall until it contacts a wall burner. At this point, the momentum of the wall burner firing radially along the wall contacts the vertical flow from the hearth burner. At this point, the vertical flow is kicked off the wall and a vortex is formed. The conventional case is shown in FIG. 1, which shows a computational fluid dynamics (CFD) simulation that presents the flow pattern defined by release of weightless particles from the hearth burner. There is so much energy in the wall combustion that the vortex is short and disorganized. Further, the hearth flow does not reattach to the wall. The point where the vortex forms is usually the point where the heat release is at a maximum and thus where the metal temperatures are highest.

Wall stabilized combustion pulls a flame back to the wall if the flame is "rolling over" toward the coil. It also increases the vertical momentum of the hearth burner flow and thus provides more resistance to the wall burner kicking this flow off the wall and forming a vortex. In many cases, the vortex occurs higher up in the firebox.

When the wall burners are operated at significantly below stoichiometric combustion (e.g., ≦85% of theoretical air including any fuel injected through the wall below the wall burners), and the hearth burners are operated with high excess air, including any fuel for base burners or secondary staged tips on hearth burners, the hearth flow has much more flow energy than the wall burner flow. Since the air/fuel mix from the wall is sub-stoichiometric, the combustion is slower (starved for oxygen) and the radial intensity is less. Thus the hearth flow can dominate.

Figure 2:
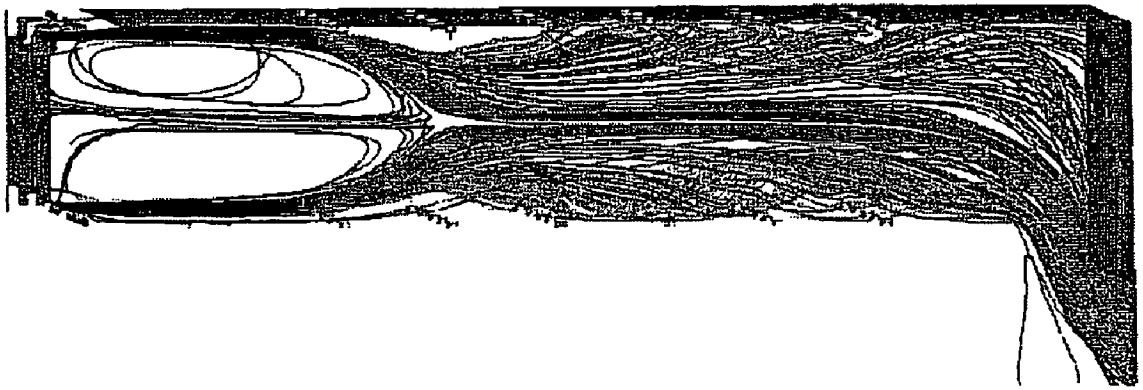
FIG. 2 shows the flow pattern through a heater having hearth burners operated with high excess air.

Sub-stoichiometric wall burner combustion allows for a better, more uniform vortex formation (at a level above the lowest row of wall burners) and thus smoothes out the flux profiles by controlling the heat release or combustion profiles. As a result, the metal temperatures are lower. FIG. 2 shows the smoother pathlines of flow that are obtained when air is moved from the wall burners to the hearth burners. The simulations shown in FIGS. 1 and 2 use 10% excess air based upon the overall firing to the furnace.

In some cases, use of substoichiometric quantities of fuel in the wall burners, with the additional air being added in the hearth burners to result in at least stoichiometric conditions overall, and in many cases 10-15% excess air overall, results in a decrease in the maximum tube metal temperature in an amount of about 10 to about 70 K, or about 12 to about 40 K, or about 15 to about 30 K for conventional fuels. The magnitude of the reduction is dependent upon the relative firing of wall burners compared to hearth burners, with higher values resulting for furnaces that have a higher percentage of firing wall burners. For synthesis gas, the decrease in the maximum tube metal temperature as a result of using substoichiometric quantities of air in the wall burners with the additional air being added in the hearth burners can be about 10 to about 80 K, or about 12 to about 50 K, or about 15 to about 40 K. The higher values reflect the differences in fuel composition.

In many instances, use of substoichiometric quantities of fuel in the wall burners, with the additional air being added in the hearth burners to result in at least stoichiometric conditions overall, and in many cases 10-15% excess air overall, results in a decrease in the maximum heat flux along the length of the coil by at least 3 to about 15%, or about 4 to about 12%, or about 5 to about 10%.

As used herein, "conventional fuel" refers to mixtures comprising methane, hydrogen, and higher hydrocarbons that exist as vapors as they enter the furnace. Non-limiting examples of conventional fuels include refinery or petrochemical fuel gases, natural gas, or hydrogen. As used herein, "synthesis gas" is defined as a mixture comprising carbon monoxide and hydrogen. Non-limiting examples of synthesis gas fuels include the products of the gasification or partial oxidation of petroleum coke, vacuum residues, coal, or crude oils. All ratios and percentage values used herein are based on mass unless specifically indicated otherwise.

Figure 3:
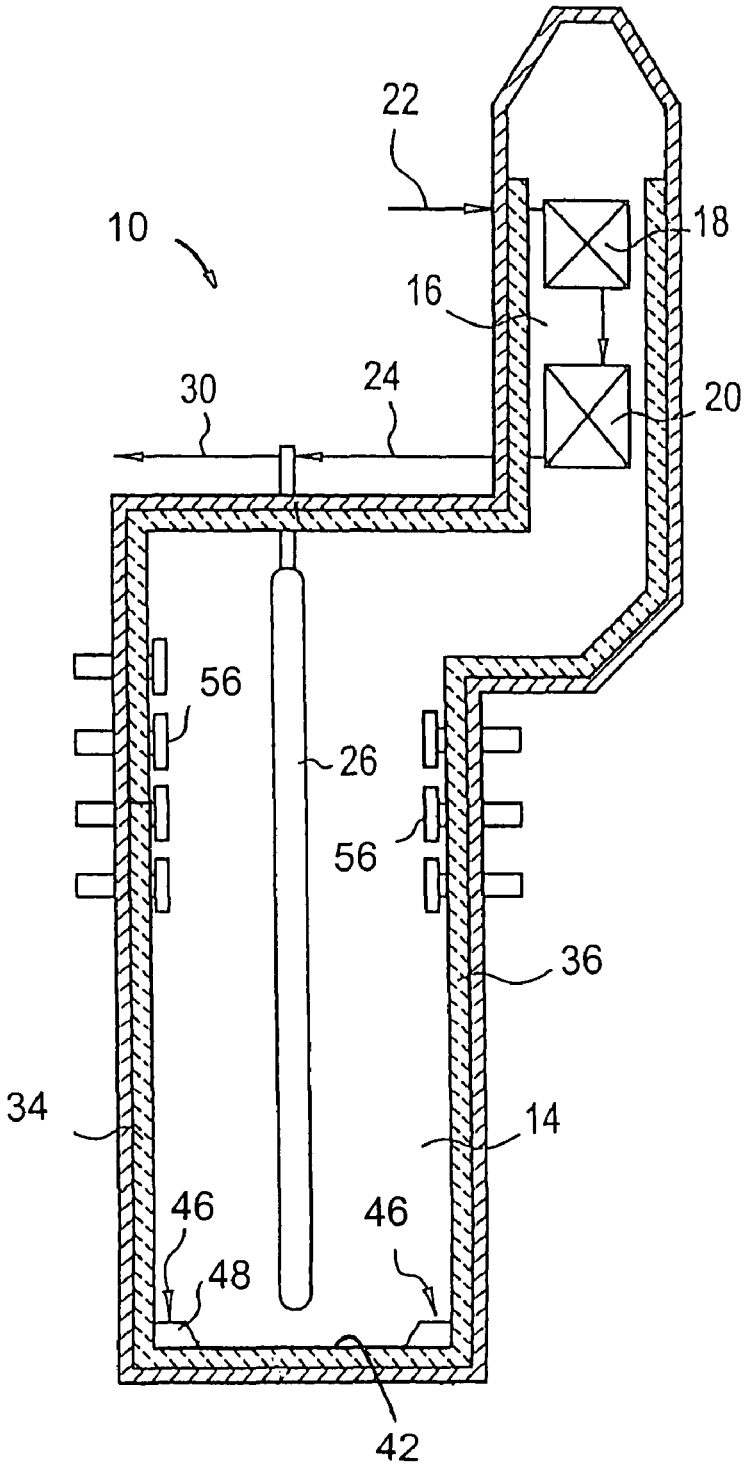
FIG. 3 is a simplified vertical cross-section representation of a pyrolysis heater.

FIG. 3 shows a cross section of a pyrolysis heater 10. Heater 10 has a radiant heating zone 14 and a convection heating zone 16. Located in the convection heating zone 16 are the heat exchange surfaces 18 and 20 which in this case are illustrated for preheating the hydrocarbon feed 22. This zone may also contain a heat exchange surface for producing steam. The preheated feed from the convection zone is fed at 24 to the heating coil generally designated 26 located in the radiant heating zone 14. The cracked product from the heating coil 26 exits at 30. The heating coils may be any desired configuration including vertical and horizontal coils.

The radiant heating zone 14 comprises walls designated 34 and 36 and a floor or hearth 42. Mounted on the floor are the vertically firing hearth burners 46 which are directed up inside radiant heating zone 14. Each burner 46 is housed within a tile 48 on the hearth 42 against one of the walls 34 and 36.

Figure 4:
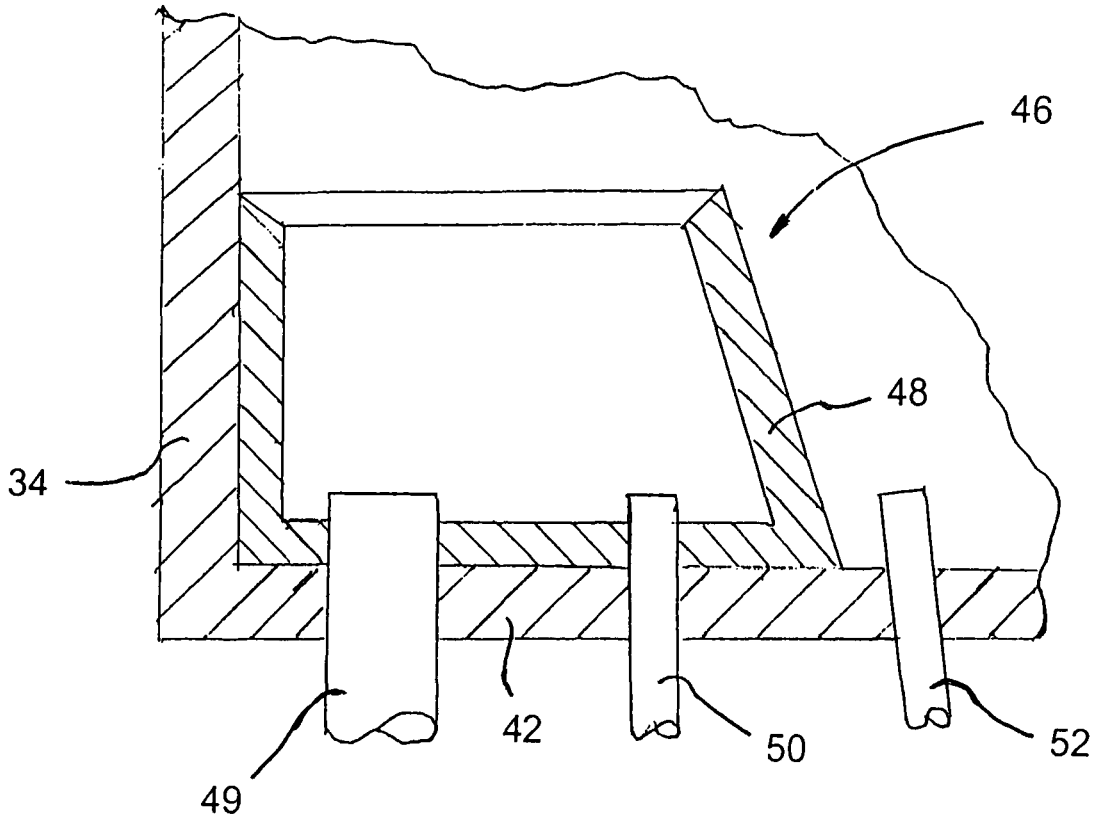
FIG. 4 is a cross section of a hearth burner.

Hearth burners can be of differing designs. In the arrangement shown in FIG. 4, the hearth burner 46 consists of a burner tile 48 on the hearth 42 against the wall 34 through which the main combustion air and fuel enter the heater. Each of these burners 46 contains one or more openings 49 for the main combustion air and one or more primary fuel nozzles 50 for the fuel. In addition, there may be a spoiler to create turbulence and allow the flame to remain in the tile (not shown). There may be additional fuel nozzles 52 located outside the tile. In other embodiments, opening 49 and fuel nozzle 50 are not the sole source for air and fuel for burner 46. Rather, additional openings and fuel nozzles (not pictured) are located proximate to burner 46 such that these additional openings and fuel nozzles are associated with burner 46.

In addition to the hearth burners, the wall burners 56 are included in the upper part of the firebox. The wall burners 56 are mounted on the walls. The wall burners are designed to produce flat flame patterns which are spread across the walls to avoid flame impingement on the coil tubes. The air flow is created by either the natural draft of the furnace, induced draft created by a fan located at the outlet of the convection heating zone 16 by a venturi system where fuel is used to inspirate the air into the furnace, or a combination of the above. Fuel is injected in several places in the burner. Primary fuel is injected at inlet 50 into the flowing air stream to initiate combustion usually within the tile opening and provide for vertical acceleration into the firebox. This acceleration pushes the flame up along the wall. For burners designed to operate with lower $NO_x$, there is typically a secondary fuel nozzle 52 located at the edge of the tile. This nozzle "stages" the fuel to the flowing air stream. By staging the fuel, the rate of combustion is slowed by the time required for fuel-air mixing, leading to lower temperatures and thus reduced $NO_x$. These secondary nozzles usually are considered part of the hearth burner system. Depending upon the angle of injection, the fuel from nozzles 52 reaches the air stream at differing heights above the burner tile. This results in raising or lowering the point of maximum combustion.

Hearth and wall burners generally are designed to each operate independently and are typically operated with air to fuel ratios that are specifically intended to achieve stoichiometric combustion or, in many cases, slightly greater than stoichiometric combustion (e.g. 10% excess air). The disadvantage of some conventional burner operation methods is that they produce intense points of maximum combustion leading to hot spots on the pyrolysis coil at that point in the furnace. Hot spots created when a furnace is operated under conditions of near stoichiometric combustion are more intense than when operated away from stoichiometric combustion. One method of avoiding hot spots involves the introduction of excess air into the furnace. However, introducing excess air also tends to reduce the overall thermal efficiency of the furnace.

A known approach for adjusting the temperature of combustion in a furnace involves fuel staging, or the process of moving fuel outside the combustion zone and letting the fuel mix with excess air. As indicated above, conventional hearth burners operate with a mix of fuel and air at slightly above stoichiometric conditions (approx. 10-15% excess air). These conditions produce stiff flames within the firebox and there is minimal flame impingement on the coils. With the onset of $NO_x$ requirements, fuel staging has been used. For systems using hearth burners, "secondary" hearth burner fuel has been introduced at points further and further away from the location of the "primary mix" that initiated combustion. Under these conditions, as the lean flame moves up into the firebox, the "secondary" fuel mixes slowly into the flame and completes combustion at a net lower temperature. When wall burners are employed in a furnace, the heat release profile that is obtained is the result of the hearth burners controlling the heat release characteristics of the lower portion of the firebox, while the wall burners control the heat release characteristics of the upper portion of the firebox. In furnaces where both hearth and wall burners are used, the high heat release from the floor creates a "hot spot" in the firebox that creates a corresponding high point in the heat release profile.

The location and intensity of a hot spot from any burner is dependent on the fuel combustion kinetics of a particular fuel and air mixture. The closer to stoichiometric the combustion is, the greater the temperature of the hot spot. Further, under close to or near stoichiometric conditions, peak combustion occurs at some distance from the burner, i.e. away from the point of combustion initiation. The kinetics of combustion and the kinetics of mixing the air and fuel define a heat release profile for the flame. Typically, the lower portion of the flame is cool but as mixing occurs, the more heat is released which eventually creates a concentrated zone of high heat release or "hot spot."

In furnaces where both hearth and wall burners are used, the high heat release from the floor creates a "hot spot" in the firebox that creates a corresponding high point in the heat release profile. The point of maximum heat release is typically at the point where the combustion from the hearth burner moving vertically up the wall meets the combustion from the wall burners moving radially from the wall burner. The combusting mixtures moving in opposite directions tend to amplify any hot spot. The point of maximum heat release from the combustion defines a point of maximum heat flux to the process coil and hence a maximum tube metal temperature.

The method disclosed herein for operating a pyrolysis heater for the pyrolysis of hydrocarbons provides for a firing pattern where the hearth burners operate with a greater than stoichiometric quantity of air for the combustion of fuel introduced at the hearth burners, and the wall burners operate with less than the stoichiometric quantity of air based on the amount of fuel introduced at the wall burners. In some embodiments, the method provides a radiant heating zone with a substantially uniform heat release profile by distributing air around the firebox to achieve particular air/fuel ratios. This contrasts with prior known practice where for pyrolysis heaters, the fuel is moved around the firebox (staged) but the net air to fuel ratio for any given burner remains within a narrow range slightly above stoichiometric.

In certain embodiments described herein, the wall burner air and fuel mixture has no more than about 85% of the stoichiometric quantity of air for combustion. In some cases, the wall burner air and fuel mixture has between about 50% to 80% of the stoichiometric quantity of air for combustion. The hearth burners provide excess air to result in a total quantity of air to the heater in about 10-15% excess over the stoichiometric amount. The quantity of excess air in the hearth burners depends upon the number of wall burners operating under less than stoichiometric conditions, considering that the firing of a single hearth burner is approximately about 6 to 10 times the firing of a single wall burner. The important criterion is the operation of the wall burners in sub-stoichiometric conditions. In some embodiments, the hearth burners operate with about 15% to about 100% excess air, or about 20% to about 90% excess air, or sometimes about 20% to about 80% excess air. The amount of excess air depends upon the particular firing pattern desired for the hearth and wall burners and the particular fuel in use. Usually, the overall excess air for the entire furnace remains at approximately 10-15% excess air consistent with achieving good thermal efficiency. The disclosed firing pattern leads to several effects:

The hearth burner flame with excess air has a lower temperature as compared to conventional furnace operating conditions. This leads to reduced $NO_x$ and a stable flame.

The excess air from the hearth burner flame mixes with the fuel rich effluent from the wall burner and combusts at higher elevation in the firebox as compared to conventional furnace operating conditions. This reduces hearth burner-wall burner interaction, preventing the vertical flame of the hearth burner from detaching from the wall and forming hot spots. It is also responsible for reducing $NO_x$.

The higher mass of hearth air moving vertically allows for better fuel-air mixing at the top of the firebox leading to improved heat release and more flux for the upper portion of the pyrolysis coil.

While not intending to be bound by theory, it is believed that these effects are due to changes in combustion patterns resulting from the high amount of excess air introduced at the hearth burners combined with the less than stoichiometric air for the wall burners. Typically, furnaces are run at 10-15% excess air to ensure the complete and stable combustion of fuel. In a furnace operated according to the disclosed firing pattern, the higher excess air from the hearth burners increases the mass flow of the combusting gases vertically. The higher amount of excess air from the hearth burner and lower combustion "intensity" at the wall resulting from the reduced air combine to yield a difference in momentum at the point where there is a hot spot created in a conventional hearth/wall fired furnace and minimize the detachment of the flame from the wall. The disclosed firing pattern also changes the "typical" heat flow pattern within the box to increase the length of the vortex zone. The use of a sub-stoichiometric mix of fuel and air in the wall burner allows for rapid combustion of the wall burner fuel in a fuel rich environment until the available air is nearly consumed, before changing to a more gradual combustion as the fuel rich mixture mixes with the excess air from the lower part of the firebox introduced in the hearth burners. The combination of more excess air in the hearth burners and sub-stoichiometric air in the wall burners thus also reduces $NO_x$ and provides a smoother heat release profile across the vertical length of the firebox, and promotes more uniform coil metal temperatures and better use of coil metallurgy. In sum, operating a pyrolysis furnace according to the disclosed firing pattern improves coil utilization by effecting greater uniformity in the tube metal temperature and flux profile over the coil throughout the elevation of the firebox as evidenced by the data provided below.

It should be understood that the following examples are given only for purposes of illustration and in order that the firing method disclosed herein may be more fully understood. These examples are not intended to limit in any way the scope of the disclosure unless otherwise specifically indicated.

EXAMPLE 1

Figure 5:
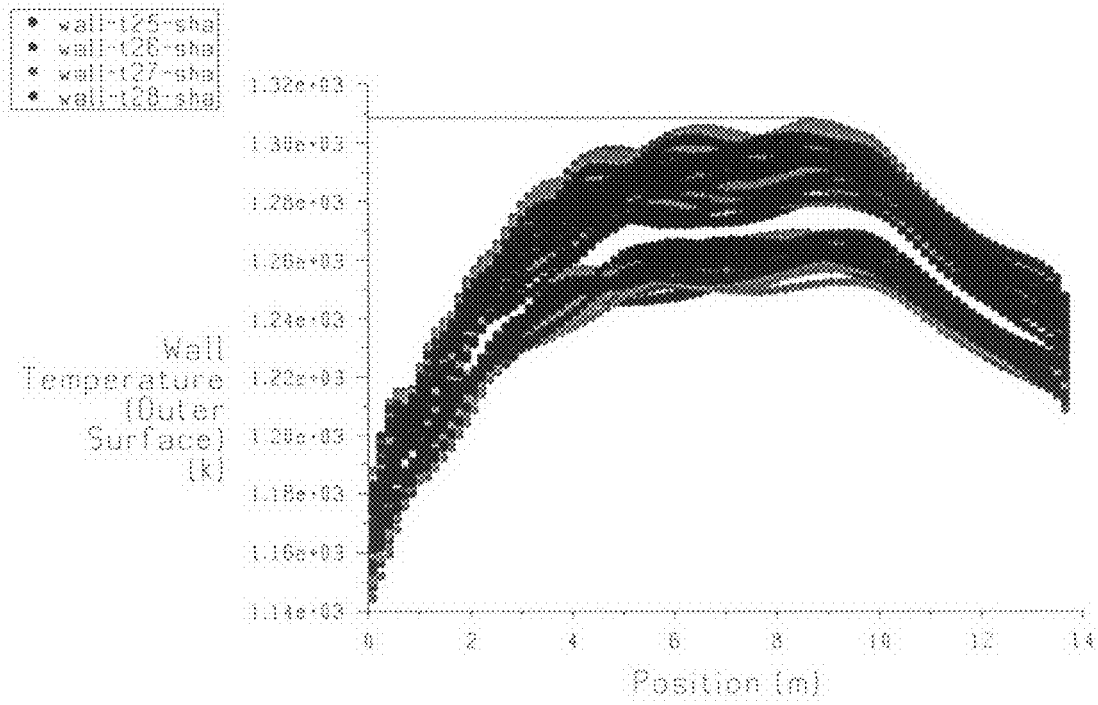
FIG. 5 is a computational fluid dynamics simulation showing a typical metal temperature profile throughout the elevation of an ethylene furnace operated according to a conventional firing pattern.
Figure 6:
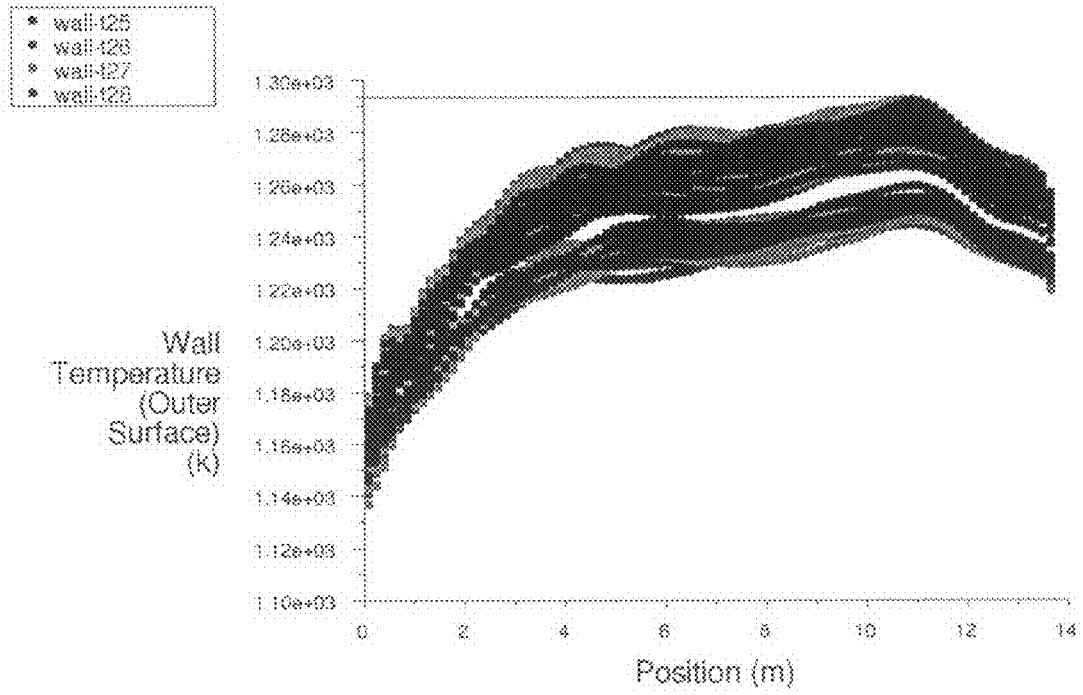
FIG. 6 is a computational fluid dynamics simulation showing the metal temperature profile throughout the elevation of an ethylene furnace operated according to an embodiment of the firing pattern of the present disclosure.

FIGS. 5 and 6 represent data from computational fluid dynamics (CFD) simulations to demonstrate the respective vertical temperature profiles of an ethylene furnace firing a methane/hydrogen fuel using a conventional firing pattern and the new firing pattern described herein. The computational fluid dynamics simulations for all examples were performed using Fluent, a commercially available computational software package available from Fluent, Inc. Other software packages known in the art can be utilized with the present invention to recreate the results described herein.

For both firing patterns, the ethylene furnace fired a total of 348 MM BTU/hr and the fuel distribution consisted of 84% to the hearth burners and 16% to a single row of wall burners. The wall burners are located at a distance of about 31 ft (9.45 meters) above the hearth. The simulations show the tube metal temperature as a function of elevation from the hearth burner to the top of furnace. The multiple lines represent various positions on the circumference of the coil at any elevation. In both cases, a hearth burner without a venturi type system was used. The "conventional case" had an opening and draft sized for achieving slightly above stoichiometric air. The examples of the new embodiments had an opening and draft sized to achieve higher air flow than the conventional case (for the sum of primary and secondary fuel in the hearth burner).

In FIG. 5 the ethylene furnace was operated according to a conventional firing pattern where both the wall burners and the hearth burners had an air to fuel ratio of 19.6, which represents approximately 10% excess of stoichiometric air.

In FIG. 6, the ethylene furnace had the same fuel distribution pattern, e.g. 84% of the fuel in the hearth burners and 16% of the fuel in the wall burners. But, in contrast to the conventional firing pattern of FIG. 5, the wall burners were designed and operated with an air to fuel mass ratio of 9.8 or approximately 50% of the stoichiometric air needed for combustion. The mass of air not injected in the wall burners was moved to the hearth burners. Given the smaller duty of the wall burners, the substantial change in the wall burner air to fuel ratio did not represent as large an impact on the hearth burner air to fuel ratio. The hearth burners were operated at an air to fuel ratio of 21.5, which represents approximately 21% excess air. The entire furnace (hearth and wall burners) operated overall at 10% excess air.

Comparing the two plots, the tube metal temperature profile resulting from the firing pattern of FIG. 6 is flatter, which is indicative of a smaller difference between the maximum and minimum temperatures over the coil length. A latter temperature profile over the height of the coil also indicates improved coil utilization and a lower peak metal temperature. Furthermore, while the examples corresponding to FIGS. 5 and 6 both had the same heat input into the process coil, the tube surface closest to the flame (top curve) of FIG. 6 had a maximum temperature of 1293K while the conventional method shown in FIG. 5 yielded a maximum tube surface temperature of 1308K. The difference is 15K. For FIG. 6, it can be seen that there is a substantially greater amount of heat absorbed in the top of the coil (higher elevation). There is no drop-off of metal temperatures in this zone that would indicate lower heat flux to the coil at that point. The bottom of the pyrolysis coil has similar conditions as evidenced by similar metal temperatures. More uniform heat flux represents better utilization of the coil.

EXAMPLE 2

Figure 7:
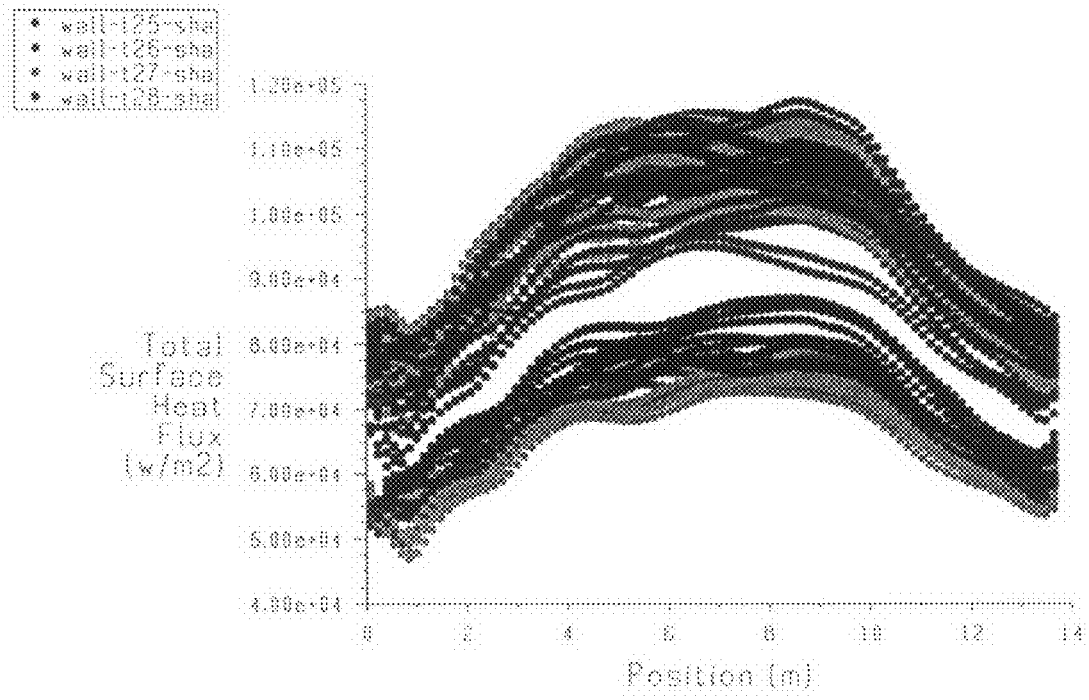
FIG. 7 is a computational fluid dynamics simulation showing a typical vertical flux profile throughout the elevation of a conventional pyrolysis heater.
Figure 8:
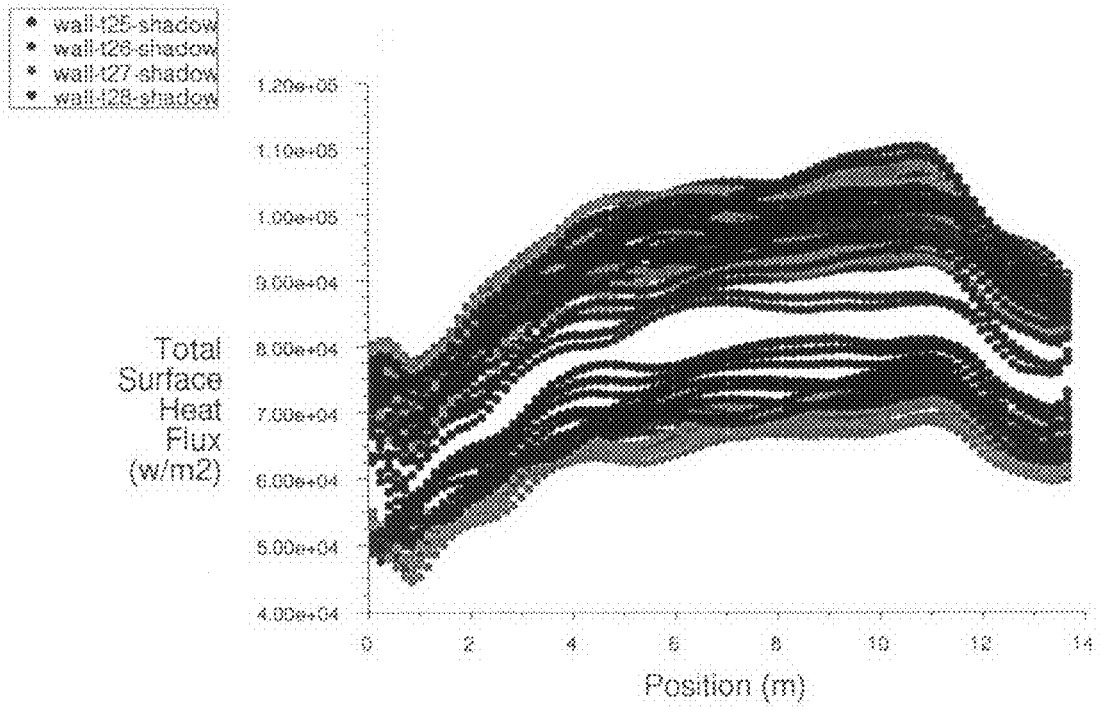
FIG. 8 is a computational fluid dynamics simulation showing the vertical flux profile throughout the elevation of a furnace operated according to an embodiment of the firing pattern of the present disclosure.

FIGS. 7 and 8 represent data from CFD simulations to demonstrate the respective vertical heat flux profiles of an ethylene furnace firing the same methane/hydrogen fuel. The cases are identical to the cases shown in FIGS. 5 and 6. The furnaces are operated according to a conventional firing pattern and an embodiment of the new firing pattern described herein. In FIG. 7, the plot has a pronounced "peak heat flux" of 1.2 e+5 w/m2 at an elevation approximately 9 meters from the bottom of the firebox. This is at the elevation of the single row of wall burners in that heater. The top and bottom portions of the coil are relatively colder than the middle portion of the coil. Thus, the more pronounced peak of FIG. 7 illustrates the presence of a "hot spot" that forms as a result of increasing the flux in the firebox under conventional firing conditions at the point where the hearth burner flame encounters the wall burner flame.

The plot of FIG. 8 does not show the extreme heat flux differential between the top, bottom and middle portions of the coil that were evident in FIG. 7. As a result, the firing pattern of the present disclosure produces a flatter flux profile with a maximum flux of $1.12\times10^5$ w/m$^2$ at an elevation of approximately 11 meters above the hearth or significantly above the elevation of the row of wall burners. The reduction in maximum flux is about 6.7%. This reduction translates into the 15 K reduction in maximum tube metal temperature.

EXAMPLE 3

The effect of moving air around the firebox was even more pronounced when alternate fuels were fired. A CFD simulation was conducted in which a pyrolysis furnace was fired with synthesis gas instead of the conventional 90:10 methane: hydrogen mixture. The composition of the synthesis gas was:

TABLE 1

| Mol % | Conventional Fuel | Synthesis Gas |
|---|---|---|
| $CH_4$ | 90 | 0 |
| $H_2$ | 10 | 37.1 |
| CO | 0 | 43.6 |
| $CO_2$ | 0 | 19.3 |
| Total | 100 | 100 |
| Heating Value (BTU/lb) | 22000 | 4280 |
| Air/Fuel (Stoic. ratio) | 17.5 | 2.6 |

The synthesis gas fuel required considerably lower amounts of air per unit fuel. The stoichiometric air to fuel ratio for this synthesis gas fuel was 2.6.

Figure 9A:
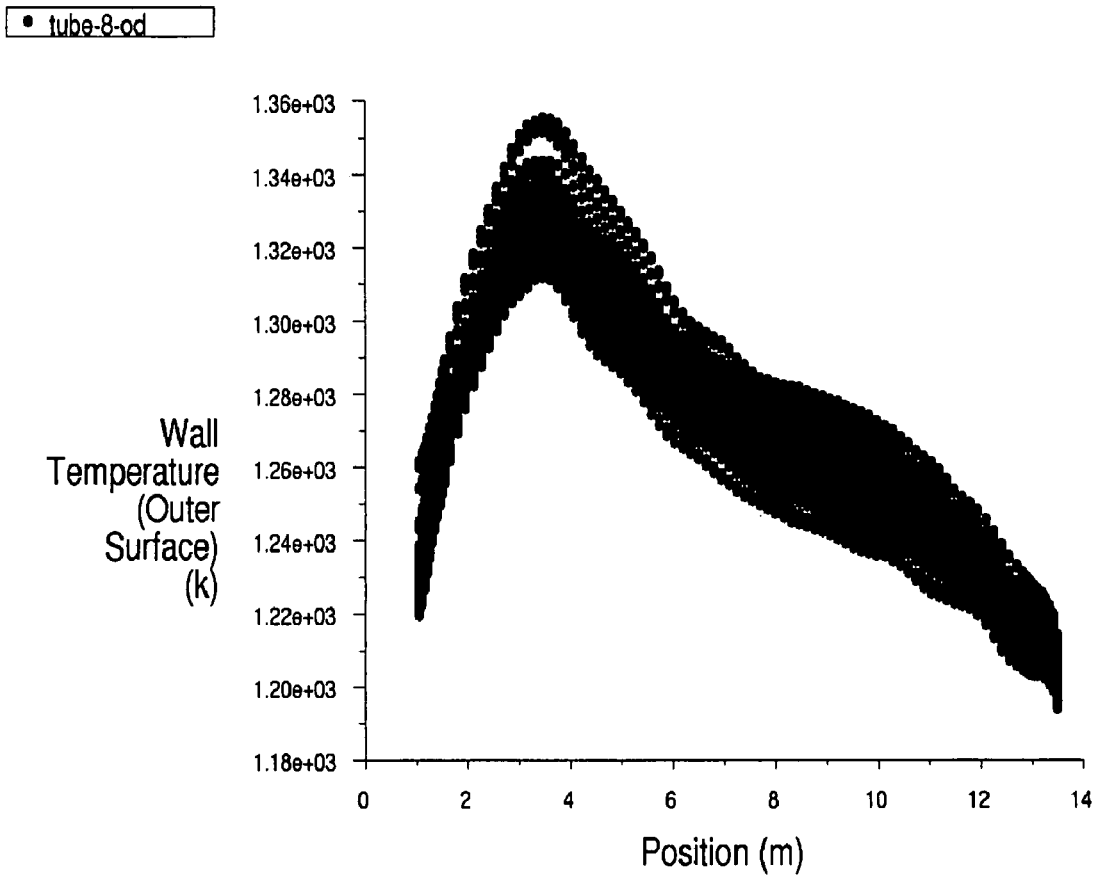
FIGS. 9A and 9B are graphs showing the outlet tube metal temperature profile throughout the elevation of an ethylene furnace firing synthesis gas fuel using conventional firing conditions (FIG. 9A) and according to an embodiment of the firing pattern of the present disclosure (FIG. 9B).
Figure 9B:
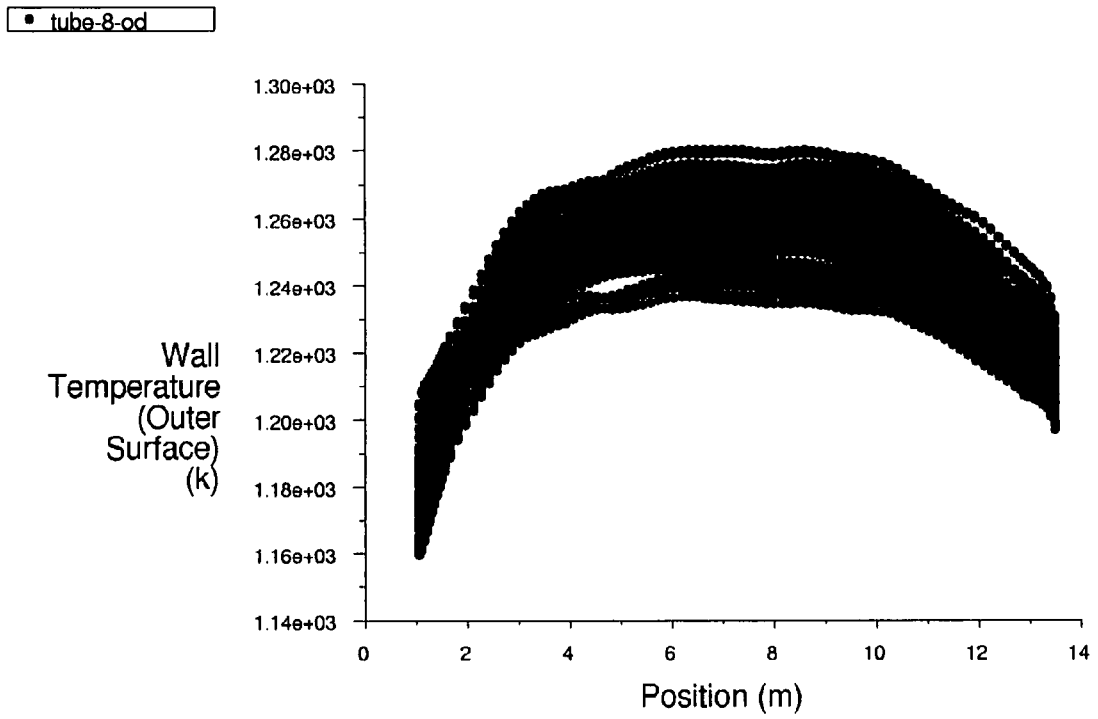

FIGS. 9A and 9B are graphs showing the respective outlet tube metal temperature profiles throughout the elevation of an ethylene furnace firing the synthesis gas fuel under conventional firing conditions and under conditions according to an embodiment of the present invention. FIGS. 9A and 9B represents data from CFD simulations of an ethylene furnace in which 45% of the fuel was distributed to the hearth burners and 55% of the fuel was distributed to six (6) rows of wall burners that were located along the furnace.

In FIG. 9A, the air to fuel mass ratio for all burners (hearth and wall burners) was 3.02 which reflected a 15% excess air condition. As indicated by the graph, the conventional firing pattern produces a "spiked" temperature profile with a maximum temperature of 1355K. The combustion of this fuel proceeded very rapidly as a result of the higher hydrogen content in that fuel. It is noted that the hydrogen component has a very high heat release and burns rapidly. This led to a point of maximum combustion lower in the furnace that was quite intense.

In FIG. 9B, the same ethylene furnace and fuel distribution pattern was used; however, air to the wall burners was reduced to 63% of the stoichiometric amount or a mass air to fuel ratio of 2.19 (including the fuel fired on the wall for wall stabilization). The balance of air was directed to the hearth burners. Under the circumstances of a much higher percentage of the fuel fired in the wall burners and the operation of these burners at sub-stoichiometric conditions, the hearth burners operate at a 60% excess of stoichiometric. As illustrated in the graph of FIG. 9B, the firing pattern that was used had a dramatic effect on the tube metal temperature. The plot was not a spiked peak but rather a smooth curve with a maximum temperature of 1280K. As compared to conventional firing conditions, operation of the furnace according to the new firing pattern described herein produced a 75K reduction in the maximum tube metal temperature.

EXAMPLE 4

A CFD was conducted in which three different levels of firing were used with conventional fuels. Progressively lower tube metal temperatures resulted as the air in the wall burners was reduced below stoichiometric. The fuel was a 90/10 methane hydrogen mix. The results are shown below on Table 2.

TABLE 2

Ethylene Heater Study Conventional Fuel

| | Case | | |
|---|---|---|---|
| Air to Fuel Ratio | 4-1 | 4-2 | 4-3 |
| Total | 18.58 | 18.37 | 18.55 |
| Hearth | 20.71 | 22.88 | 19.02 |
| Wall | 17.15 | 15.33 | 18.26 |
| Coil Outlet T, K | 1102 | 1101 | 1106 |
| Bridgewall T, K | 1446 | 1466 | 1442 |
| Flue Gas O2 mole frac | .0115 | .0095 | .0096 |
| Max TMT, K | 1288 | 1270 | 1300 |

Table 2 shows that as fuel ratios change, maximum tube metal temperatures (TMTs) shift. The highest hearth air results in the lowest metal temperatures (case 4-2).

The embodiments described herein are particularly useful in the production of olefins, and are useful in systems employing conventional as well as low $NO_x$ burners. The embodiments are particularly useful where a larger number of wall burners are employed and where alternate fuels are used.

Although the embodiments have been described with reference to ethylene furnaces, the firing pattern is not limited to such burners, or their arrangements or details. Furnaces that fire with a combination of wall burners and hearth burners where the wall burners are operated with less than about 80% of the stoichiometric air required, or between 50% to 80% of the stoichiometric air required with the balance of air being introduced at the hearth burners, which operate with between about 20% to 100% excess air, are included. Higher amount of air also can be used. The scope is also not limited by the pattern or locations of the wall and/or hearth burners within the furnace. Similarly, other modifications, adaptations and alternatives may occur to one skilled in the art without departing from the spirit and scope of the embodiments described herein.

The invention claimed is:

1. A method of operating a heater including a radiant heating zone comprising a lower portion including a hearth burner section and an upper portion including a wall burner section; at least one tubular heating coil located in the radiant heating zone, the heating coil having a length; the hearth burner section comprising a plurality of hearth burners located adjacent to the bottom hearth for firing in the radiant heating zone; and the wall burner section comprising a plurality of wall burners located adjacent to opposing walls, the method comprising:

introducing to the wall burner section a first air and fuel mixture having less than the stoichiometric quantity of air for combustion of fuel introduced to the wall burner section, and introducing to the hearth burner section a second air and fuel mixture having greater than the stoichiometric quantity of air for combustion of fuel introduced to the hearth burner section, the overall quantity of air introduced to the hearth burner section and wall burner section being at least a stoichiometric quantity.

2. The method of claim 1 wherein the first air and fuel mixture comprises no more than about 85% of the stoichiometric quantity of air for combustion.

3. The method of claim 1 wherein the first air and fuel mixture comprises about 50% to about 80% of the stoichiometric quantity of air for combustion.

4. The method of claim 1 wherein the mixture of air and fuel introduced to each of the wall burners has a sub-stoichiometric quantity of air for combustion of fuel introduced to said wall burner.

5. The method of claim 4 wherein the mixture of air and fuel introduced to each of the hearth burners has greater than the stoichiometric quantity of air for combustion of fuel introduced to the hearth burner.

6. The method of claim 2 wherein the mixture of air and fuel introduced to each of the wall burners has a sub-stoichiometric quantity of air for combustion of fuel introduced to said wall burner.

7. The method of claim 4 wherein the plurality of hearth burners supply the balance of said stoichiometric quantity of air for the combustion of fuel introduced to the wall burner section.

8. The method of claim 1 wherein the heater operates with about 10-15% greater than stoichiometric quantity of air for combustion overall.

9. The method of claim 1 wherein greater than the stoichiometric quantity of air for combustion of fuel introduced to the hearth burner section comprises about 20% to 100% excess air.

10. The method of claim 1 wherein at least one of the wall burner section and the hearth burner section includes a supplemental introduction point for at least one of air and fuel.

11. The method of claim 1 wherein the fuel contains at least 25% hydrogen gas.

12. The method of claim 1 wherein use of less than the stoichiometric quantity of air in the wall burner section reduces the temperature difference along said heating coil as compared to a system in which a stoichiometric quantity of air is introduced in the wall burner section.

13. A method of operating a heater including a radiant heating zone comprising a lower portion including a hearth burner section and an upper portion including a wall burner section; at least one tubular heating coil located in the radiant heating zone; the hearth burner section comprising a plurality of hearth burners located adjacent to the bottom hearth for firing in the radiant heating zone; and the wall burner section comprising a plurality of wall burners located adjacent to opposing walls, the method comprising:

introducing a first air and fuel mixture to the wall burner section, the first air and fuel mixture having less than the stoichiometric quantity of air for combustion;

introducing a second air and fuel mixture to the hearth burner section in a direction generally parallel to the length of the heating coil, the second air and fuel mixture having more than the stoichiometric quantity of air for combustion; and combusting the fuel and air in the radiant heating zone, wherein air and a portion of the fuel introduced at the wall burner section combusts at a first combustion rate and a portion of the air introduced at the hearth burner section combusts with a portion of the fuel introduced at the wall burner section at a second combustion rate that is slower than the first combustion rate.

14. The method of claim 13, wherein the temperature difference along the length of the heating coil is at least 10 K smaller than the temperature difference along a heating coil for an equivalent heater using equivalent overall flow rates of fuel and air in which a stoichiometric quantity of air is introduced at the wall burner section.

15. The method of claim 13 wherein the first air and fuel mixture has no more than about 85% of the stoichiometric quantity of air for combustion.

16. The method of claim 13 wherein the second air and fuel mixture has between 20% to 100% more than the stoichiometric quantity of air for combustion.

17. The method of claim 13 wherein the wall burner section includes a supplemental introduction point for at least one of air and fuel.

18. The method of claim 13 wherein the hearth burner section includes a supplemental introduction point for at least one of air and fuel.

19. The method of claim 13 wherein the heater operates with at least about 10% greater than the stoichiometric quantity of air overall.

20. The method of claim 13, wherein the fuel contains at least 25 mol % hydrogen gas.

21. A heater comprising:

a. a radiant heating zone comprising a lower portion including a hearth burner section and an upper portion including a wall burner section;

b. at least one tubular heating coil located in the radiant heating zone, the heating coil having a length;

c. the hearth burner section comprising a plurality of hearth burners located adjacent to the bottom hearth portion, the hearth burner section being configured to fire with greater than stoichiometric amounts of air; and d. the wall burner section comprising a plurality of wall burners, the wall burners being configured to fire along opposing walls in the radiant heating zone with less than stoichiometric amounts of air, the heater being configured to operate with at least about 10% excess of air.

22. The heater of claim 21 wherein the balance of air for firing the wall burners is introduced at the hearth burners.

23. The heater of claim 21 wherein the hearth burner section includes a supplemental introduction point for at least one of air and fuel.

24. The heater of claim 21 wherein the hearth burner section includes a supplemental introduction point for air.

25. The heater of claim 21 wherein the wall burner section fires with less than 85% of the stoichiometric amount of air.

26. The heater of claim 21 wherein the hearth burner section fires with between 20% to 100% greater than the stoichiometric amount of air.

27. The heater of claim 21 wherein the wall burner section fires with between 50% to 80% of the stoichiometric amount of air and the hearth burner section supplies at least the balance of the stoichiometric quantity of air for the combustion of fuel introduced to the wall burners.

28. The heater of claim 21, wherein the hearth burners and wall burners are operated with a fuel containing at least 25 mol % hydrogen.

29. A firing pattern for a gas heater having a lower hearth burner section and an upper wall burner section, the firing pattern comprising introducing to the wall burner section a mixture of air and fuel with less than the stoichiometric quantity of air for combustion and feeding additional air to the hearth burner section to result in an overall net excess of air being fed to the heater.

30. The firing pattern of claim 29 wherein the wall burner section fires with less than 85% of the stoichiometric amount of air.

31. The firing pattern of claim 29 wherein the hearth burner section fires with between 20% to 100% greater than the stoichiometric amount of air.

32. The firing pattern of claim 29 wherein the gas heater is a pyrolysis heater with a heating coil, and the firing pattern reduces the difference between the maximum and minimum outer surface temperature along the length of the heating coil by at least 10 K as compared to an equivelent heater having a firing pattern in which the same fuel distribution pattern is used but the wall burner section is operated using at least a stoichiometric quantity of air.

33. The firing pattern of claim 29 wherein the gas heater is a pyrolysis heater with a heating coil, and the firing pattern reduces the maximum heat flux along the length of the heating coil by at least 4% as compared to an equivelent heater having a firing pattern in which the same fuel distribution pattern is used but the wall burner section is operated using at least a stoichiometric quantity of air.

34. A method of operating a heater including a radiant heating zone comprising a lower portion including a hearth burner section and an upper portion including a wall burner section; at least one tubular heating coil located in the radiant heating zone; the hearth burner section comprising a plurality of hearth burners located adjacent to the bottom hearth for firing in the radiant heating zone; and the wall burner section comprising a plurality of wall burners located adjacent to the opposing walls, the method comprising:

introducing a first air and fuel mixture comprising no more than about 85% of the stoichiometric quantity of air for combustion to the wall burner section, the first air and fuel mixture having less than the stoichiometric quantity of air for combustion;

introducing a second air and fuel mixture comprising between 20% to 100% more than the stoichiometric quantity of air for combustion to the hearth burner section in a direction generally parallel to a heating coil, the second air and fuel mixture having more than the stoichiometric quantity of air for combustion; and combusting the fuel and air in the radiant heating zone, wherein the air and a portion of the fuel introduced at the wall burner section combusts at a first rate and a portion of the air introduced at the hearth burner section combusts with a portion of fuel introduced at the wall burner section at a second combustion rate that is slower than the first combustion rate to reduce the overall combustion rate in the wall burner section of the heater, wherein the heater operates with at least about 10% greater than the stoichiometric quantity of air overall.

* * * * *